United States Patent [19]

Paton et al.

[11] 4,045,949

[45] Sept. 6, 1977

[54] INTEGRAL, ELECTRICALLY-CONDUCTIVE TEXTILE FILAMENT

[75] Inventors: George A. Paton, Newport News; Sterling M. Nichols, Williamsburg; John H. Sanders, Newport News, all of Va.

[73] Assignee: Dow Badische Company, Williamsburg, Va.

[21] Appl. No.: 681,680

[22] Filed: Apr. 29, 1976

Related U.S. Application Data

[63] Continuation-in-part of Ser. No. 646,311, Jan. 2, 1976, abandoned.

[51] Int. Cl.[2] ..... D02G 3/04; D02G 3/44

[52] U.S. Cl. ..... 57/140 BY; 57/157 AS; 428/359; 428/367; 428/372; 428/374

[58] Field of Search ..... 428/367, 368, 370, 372, 428/373, 374, 397, 394, 359; 57/140 BY, 140 R, 157 AS; 264/171

[56] References Cited

U.S. PATENT DOCUMENTS

| | | | |
|---|---|---|---|
| 2,428,046 | 9/1947 | Sisson et al. | 428/370 |
| 3,531,368 | 9/1970 | Okamoto et al. | 428/374 |
| 3,582,448 | 6/1971 | Okuhashi et al. | 428/367 |
| 3,586,597 | 6/1971 | Okuhashi et al. | 428/370 |
| 3,669,736 | 6/1972 | Fujiwara et al. | 428/368 |
| 3,672,802 | 6/1972 | Matsui et al. | 264/171 |
| 3,700,545 | 10/1972 | Matsui et al. | 428/374 |
| 3,708,335 | 1/1973 | Fujiwara et al. | 428/370 |
| 3,823,035 | 7/1974 | Sanders | 428/367 |

*Primary Examiner*—Lorraine T. Kendell
*Attorney, Agent, or Firm*—George F. Helfrich

[57] ABSTRACT

The invention is an integral, electrically-conductive textile filament comprising from 2 to about 1000 electrically-conducting, longitudinally-directed strata of fiber-forming polymeric material, and one non-conducting stratum of the same polymeric material in coextensive union with each electrically-conducting stratum along the length of at least one of its major surfaces. Each electrically-conducting stratum of polymeric material has dispersed therein finely-divided particles of electrically-conductive carbon black. The electrical resistance of the integral filament is not more than about $10^9$ ohms/cm.

4 Claims, 2 Drawing Figures

INTEGRAL, ELECTRICALLY-CONDUCTIVE TEXTILE FILAMENT

CROSS REFERENCE

This application is a continuation-in-part of our copending application Ser. No. 646,311, filed Jan. 2, 1976 now abandoned.

BACKGROUND OF THE INVENTION

1. Field of the Invention

This invention relates to textiles in general, and in particular to an electrically-conductive textile fiber for use in the construction of antistatic fabrics of various kinds.

2. Prior Art

The accumulation of static electricity as a result of the utilization of fabrics is a phenomenon which has commanded the attention of the textile industry for some time. The presence of static is a cause not only of annoyance — (e.g. items of apparel cling to the body and are attracted to other garments; fine particles of lint and dust are attracted to upholstery fabrics, increasing the frequency of required cleaning; one experiences a jolt or shock upon touching a metal doorknob after walking across a carpet) — but also of danger (e.g. the discharge of static electricity can result in sparks capable of igniting flammable mixtures such as ether/air, which are commonly found in hospitals, especially in operating rooms). All of these effects are accentuated in atmospheres of low relative humidity.

Of the many proposals for preventing the undesirable buildup of static electricity, the most satisfactory, with respect to their efficiency and permanence, have appeared to be those which comprehend the utilization of fibers possessing electrical conductivity (e.g. metal fibers; fibers coated with electrically-conductive material; fibers containing conductive, block copolymeric materials dispersed therein in the form of long, slender particles; integral fibers having a sheath or core containing electrically-conductive material; and metallic laminate filaments) in combination with common natural or man-made fibers to produce a woven, knitted, netted, tufted, or otherwise fabricated structure, which readily dissipates the static charges as they are generated. Some of the more noteworthy of these methods and structures may be found in U.S. Pats. Nos. 2,129,594; 2,714,569; 3,069,746; 3,288,175; 3,329,557; 3,582,444; 3,582,445; 3,582,448; 3,586,597; 3,590,570; 3,637,908; 3,639,502; 3,729,449; 3,803,453 and 3,823,035; in Webber, "Metal Fibers," *Modern Textile Magazine,* May, 1966, pp. 72–75; in Belgian Pats. Nos. 775,935 and 790,254; and in French Pat. No. 2,116,106.

Notwithstanding the efficacy of these and similar expedients, they are found lacking in certain important aspects, viz:

The manufacture of metallic fibers of fine denier, especially in the form of monofilaments, is a difficult and costly operation; and since such fibers are quite dissimilar in character from ordinary textile fibers, problems arise in connection with blending and processing, as well as in the hand of the products obtained.

Metallic laminate filaments, on the other hand, do not present blending and processing problems, because of their close similarity to ordinary textile fibers, and the hand of the products obtained is consequently not objectionable. However, the cost of such filaments is high when compared with the natural or man-made fibers with which they are blended. Textile fiber substrates, the surfaces of which have been coated by vapor deposition or electrodeposition, or by the application of adhesive compositions containing finely divided particles of electrically-conductive material, are in some cases less costly than metal fibers and/or metallic laminate filaments, depending upon the nature of the electrically-conductive material employed and the coating method chosen. However, such coatings are often found lacking in cohesion and adhesion and are frequently too thick to be practicable in some applications — especially when the nature of the electrically-conductive particulate matter is such that a high concentration thereof is required for satisfactory conductivity. Economy is generally achieved, therefore, only through sacrifices in durability of the conductivity of the fiber.

The extrusion of powdered synthetic polymer/finely divided electrically-conductive material blends directly into filaments, or as distinct coatings on filamentary substrates having the same or different polymeric compositions, is also well known. Unfortunately, these substantially homogeneous blends require a high concentration of the electrically-conductive material. They are generally not readily extruded, if at all, and any filaments and filamentary coatings which are produced therefrom have extremely poor cohesion and adhesion, and are therefore completely lacking in durability.

Filamentary polymer structures containing conductive polymeric materials (e.g. polyalkylene ether - polyamide block copolymers), which are dispersed in the polymer substrate in the form of long, slender particles or layers whose longitudinal axes are substantially parallel to the direction of molecular orientation of the filament, are difficultly obtained in a reproducible form, thereby increasing their cost and/or decreasing the ambit of their utility.

Although they have been shown to provide very beneficial results in most applications, filamentary polymeric structures having either an integral sheath or an integral core comprising electrically-conductive material are somewhat limited in their utility; viz., they are not suitable in applications requiring a very low resistance.

Although multi-component filaments are known in the art (see U.S. Pat. No. 3,531,368, which discloses a multi-component filament comprising a plurality of fine filamentary parts which are continuous along the axis of the filament), and although it is also old to modify one of the components of a multi-component filamentary structure by the introduction of additives such as antistatic agents, including electrically-conductive carbon black (see U.S. Pats. Nos. 2,428,046 and 3,582,448), the present invention as hereinbelow specified and hereinafter defined is not obvious to one of skill in the art, as only the particular combination of elements as recited herein will result in a filament having properties which obviate the deficiencies of the prior art as discussed hereinabove.

Accordingly, it is the primary object of this invention to provide a low-cost, yet durable, electrically-conductive fiber which has reproducible conductive properties over a wide range of conductivities, substantially retains the desirable physical properties of the unmodified polymeric substrate, and presents no problems in the blending and processing thereof with ordinary natural and man-made textile fibers.

SUMMARY OF THE INVENTION

This object is achieved, and the disadvantages of the prior art are obviated, by providing an integral electrically-conductive textile filament which has a resistance of not more than about $10^9$ ohms/cm and comprises:

a. from 2 to about 1000 electrically-conducting, longitudinally-directed strata of fiber-forming polymeric material having finely-divided particles of electrically-conductive carbon black uniformly dispersed therein, the concentration of electrically-conductive carbon black in each electrically-conducting stratum being within the following limits:

1. For 2 electrically-conducting strata: from about 30 percent by weight — at a total concentration of carbon in the integral filament of about ½ percent by weight — to about 70 percent by weight — at a total concentration of carbon in the integral filament of about ¼percent by weight; and ¼
2. For about 1000 electrically-conducting strata: from about 30 percent by weight — at a total concentration of carbon in the integral filament of about 12 percent by weight — to about 70 percent by weight — at a total concentration of carbon in the integral filament of about 2 percent by weight; and b. in coextensive union with each electrically-conducting stratum along the length of at least one major surface thereof, a non-conducting stratum of the same fiber-forming polymeric material.

Moreover, it is especially advantageous if the polymeric material is an acrylonitrile polymer having at least about 85 percent by weight of acrylonitrile and up to about 15 percent by weight of another polymerizable mono-olefinic monomer copolymerizable therewith.

Furthermore, the integral, electrically-conductive textile filament of the present invention is particularly useful when there are 4 electrically-conducting, longitudinally-directed strata of fiber-forming polymeric material, each having finely-divided particles of electrically-conductive carbon black uniformly dispersed therein in a concentration of 40–60 percent by weight, the total concentration of carbon in the integral filament being between 4 and 6 percent by weight.

The production of integral, electrically-conductive filaments according to the present invention is advantageously accomplished by:

1. providing a first stream of a solution of a fiber-forming polymeric material;
2. providing a second stream of the same solution of the polymeric material, and dispersing in the second stream the appropriate concentration of a finely-divided, electrically-conductive carbon black, which does not dissolve in, or react with the solvent;
3. providing a third stream identical to the first stream;
4. providing a fourth stream identical to the second stream; and
5. causing the first, second, third, and fourth streams to join in order into a composite stream without appreciable mixing of the individual component streams thereof, and spinning the resulting composite stream into integral filaments.

In a preferred embodiment of this process, the first and second streams described above are introduced simultaneously into the inlet end of an interfacial surface generator which generates between 8 and about 2000 total layers and the resulting multi-layered composite stream is spun into integral filaments by standard wet or dry spinning techniques.

In another preferred embodiment of this process, many filaments are extruded in a tow, which is cut into staple and subsequently handled by conventional methods to produce a conductive spun yarn.

BRIEF DESCRIPTION OF THE DRAWING

For a more complete understanding of the present invention, reference should be made to the detailed description of the preferred embodiments thereof, which is set forth below, which description should be read together with the accompanying drawing, wherein.

DETAILED DESCRIPTION OF THE PREFERRED EMBODIMENTS

Figure 1:
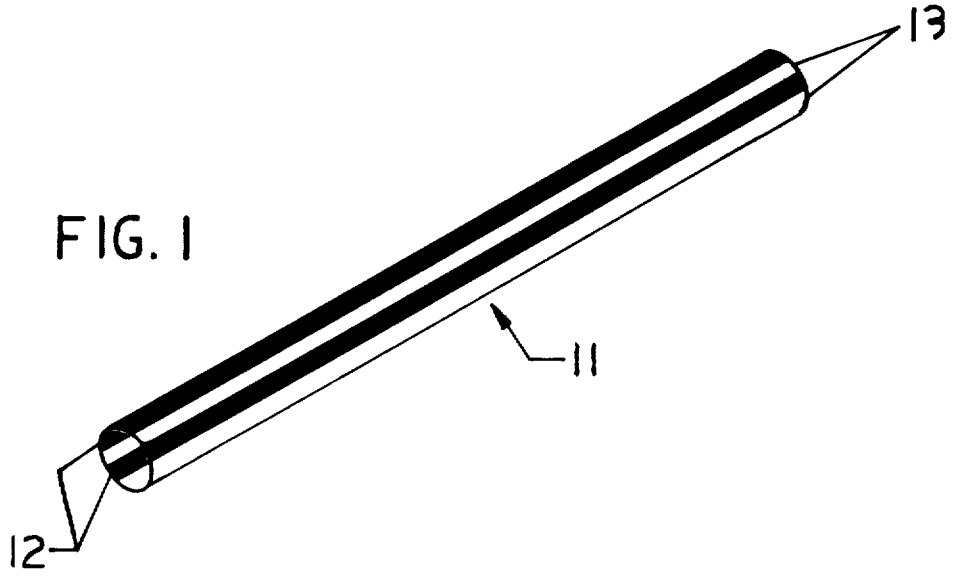
FIG. 1 and FIG. 2 are perspective views schematically illustrating embodiments of an integral, electrically-conductive filament according to the present invention.

The polymeric material comprising the integral, electrically-conductive textile filament of the present invention may be any of the well-known film or fiber-forming polymers commonly employed in the art, such as acrylics, acetates, modacrylics, cellulosics, polystyrenes, polyolefins, polyesters, and polyamides. Acrylonitrile polymers having at least about 85 percent by weight of acrylonitrile and up to about 15 percent by weight of another polymerizable mono-olefinic monomer copolymerizable therewith have been shown to be especially advantageous. The unitary filament must comprise at least two electrically-conducting, longitudinally-directed strata of fiber-forming polymeric material, each of which has uniformly dispersed therein finely-divided particles of an electrically-conductive carbon black. A particle size of about 20 to 40 μis preferred.

The number of electrically-conductive strata and the appropriate concentration of electrically-conductive carbon black in the individual electrically-conductive strata were determined empirically. In this regard, it was desired that the electrical resistance of the unitary filament be not more than about $10^9$ ohms/cm, and for many applications, between about $10^4$ and $10^9$ ohms/cm. Under the latter conditions, the unitary filament is eminently suitable for employment in a wide variety of fabrics for preventing the accumulation of high charges of static electricity while presenting no appreciable electrocution hazard.

The filament of the present invention accordingly has:

a. from 2 to about 1000 electrically-conducting, longitudinally-directed strata of fiber-forming polymeric material having finely-divided particles of electrically-conductive carbon black uniformly dispersed therein, the concentration of electrically-conductive carbon black in each electrically-conductive stratum being within the following limits:

1. For 2 electrically-conducting strata: from about 30 percent by weight — at a total concentration of carbon in the integral filament of about ½ percent by weight — to about 70 percent by weight — at a total concentration of carbon in the integral filament of about ¼ percent by weight; and
2. For about 1000 electrically-conducting strata: from about 30 percent by weight — at a total concentration of carbon in the integral filament of about 12 percent by weight — to about 70 percent by weight — at a total concentration of carbon in the integral filament of about 2 percent by weight; and b. in coextensive union with each electrically-conducting stratum along the length of at least one major surface thereof, a non-conducting stratum of the same fiber-forming polymeric material.

Furthermore, the integral, electrically-conductive textile filament of the present invention is particularly useful when there are 4 electrically-conducting, longitudinally-directed strata of fiber-forming polymeric material, each having finely-divided particles of electrically-conductive carbon black uniformly dispersed therein in a concentration of 40–60 percent by weight, the total concentration of carbon in the integral filament being between 4 and 6 percent by weight.

Figure 2:
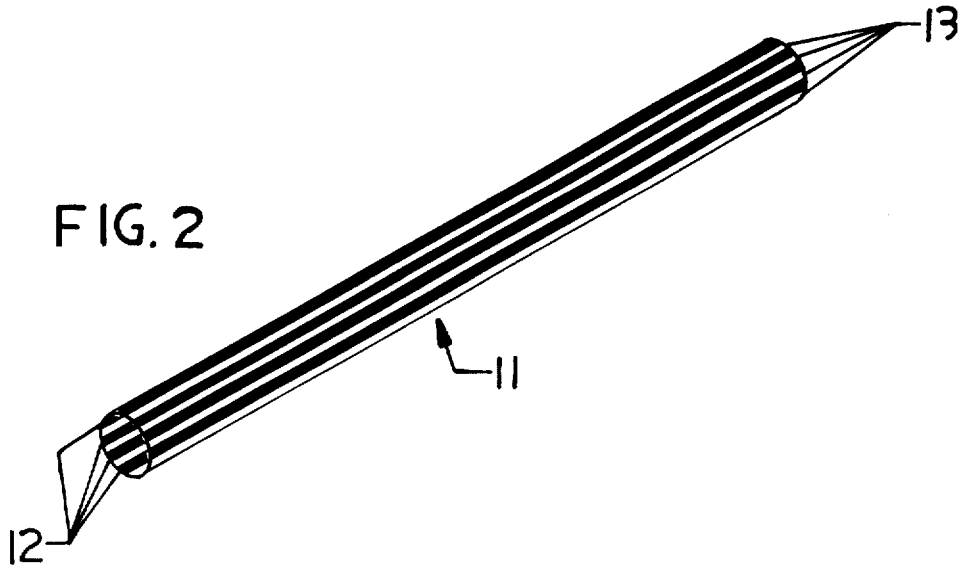

Referring to the drawing, although two longitudinally-directed electrically-conducting strata 12 are sufficient to afford the combination of properties long sought after (see FIG. 1), a larger number of electrically-conducting strata 12 has been found particularly advantageous. (See FIG. 2, wherein the preferred embodiment comprising 4 electrically-conducting strata 12 is shown.) Each electrically-conducting stratum 12 is joined in a coextensive union along the length of at least one of its major surfaces with a non-conducting stratum 13 of the same polymeric material to form an integral or unitary filamentary structure 11. As the component strata of this structure cannot be individually separated or removed from the unit, the integral structure 11 of the present invention is decidedly different from those composite structures of the prior art which, comprising distinct layers or plies joined by adhesive and/or the application of heat and pressure, are subject to delamination and/or desquamation, which in turn results in loss of conductivity of the structure. Moreover, the electrically-conducting strata 12 of the unitary structure 11 of the present invention are manifestly unlike the prior art's long, slender particles of dispersed conductive block copolymeric material, which are difficulty fashioned in reproducible form from a narrow choice of conductive polymeric materials. In contradistinction to these prior art structures, the electrically-conducting strata 12 of the unitary filament 11 of the present invention comprise finely divided particles of electrically-conductive carbon black — e.g., roughly spherical particles of electrically-conductive carbon black having an average diameter of between about 20 and 40 $\mu$ — uniformly dispersed in a non-conducting polymeric matrix. Moreover, the desired electrical conductivity of a variety of polymeric filaments is readily and economically achieved, and easily reproduced.

The height of each electrically-conducting stratum 12 is not critical. It varies with the diameter of the filament 11, the number of strata contained therein, and the consentration of carbon in each stratum. It is, of course, preferable that the strata be well-defined and continuous.

However, it is emphasized that the drawings are schematic and that the individual strata are not, and need not be perfectly defined.

Each non-conducting stratum 13 of polymeric material comprising the unitary filament 11 of the present invention is composed of the same polymeric material which comprises the matrix of the electrically-conducting strata 12. An explication and example of a preferred method of forming the union of strata which is the integral, filamentary structure 11 of the present invention is now set forth.

To prepare integral, electrically-conductive filaments according to the present invention, one may use a number of special techniques, the most advantageous of which comprehends a modification of the well-known technique of spinning a solution of a fiber-forming polymeric material in a solvent. This improvement comprises:

1. providing a first stream of a solution of the polymeric material;

2. providing a second stream of the same solution of the polymeric material, and dispersing in the second stream between about 30 and 70 percent by weight, based upon the weight of the polymeric material, of a finely-divided, electrically-conductive carbon black which does not dissolve in, or react with the solvent;

3. providing a third stream identical to the first stream;

4. providing a fourth stream identical to the second stream; and 5. causing the first, second, third, and fourth streams to join in order into a composite stream without appreciable mixing of the individual component streams thereof, and spinning the resulting composite stream into integral filaments. The polymeric material is any of the well-known film or fiber-forming polymers commonly employed in the art, examples thereof being set forth above, and the solution thereof is prepared by dissolving the chosen polymeric material in a liquid which is a good solvent therefor, but which does not react with or dissolve the finely-divided electrically-conductive carbon black which is to be dispersed in the second stream by standard techniques. The individual streams are first de-gassed, after which they are joined by introducing them simultaneously in parallel relationship into a cylindrical member which terminates in an orifice or jet. If the "wet spinning" technique has been chosen, the composite stream is "spun" or extruded through the jet into a coagulating bath, which contains a liquid which is miscible with the polymer solvent, but is itself a non-solvent for the polymer and causes the polymer to precipitate. The filament so produced is then washed, generally countercurrently with water, to remove the spinning solvent, and is then dried and finally wound on a package for subsequent utilization in the production of a wide variety of antistatic fabrics. If the "dry spinning" technique has been chosen, the solvent contained in the composite stream must be volatile, and the composite stream is spun or extruded through the jet into the air or an inert gas atmosphere, whereupon a filament is formed by evaporation of solvent from the composite stream. Dry spinning is usually effected in the art employing the cylindrical member in a vertical position. Moreover, the cylindrical member is generally jacketed for temperature control, and outfitted so that the air, steam, or inert gas may be passed over the jet either concurrently or countercurrently as required. Downward spinning is preferred for low-denier fibers and upward spinning for high deniers, for better control of draw by eliminating the influence of gravity.

Found to be of particular significance and advantage in the practice of this process is the step of introducing the first and second streams referred to above simultaneously into the inlet end of an interfacial surface generator and then passing the resulting multi-layered composite stream through the jet and into a coagulating bath or into the air or an inert gas atmosphere. Interfacial surface generators such as those specified in U.S.

Pats. Nos. 3,404,869 and 3,583,678 have been employed with beneficial results.

In a preferred embodiment, particularly good results are obtained in the preparation of filaments according to present invention when the fiber-forming polymeric material is a long-chain synthetic polymer composed of at least about 85% by weight of acrylonitrile units with the remainder being one or more other mono-olefinic monomers copolymerizable therewith, such as: vinyl acetate; alkyl esters of acrylic and methacrylic acid; vinyl bromide; as well as monomers having an affinity for acid dyestuffs, particularly those containing a tertiary or quarternary nitrogen in the molecule, such as vinyl pyridine or methyl vinyl pyridine; and monomers having an affinity for basic dyestuffs, particularly those containing a sulfonic or carboxylic acid group, such as alkyl sulfonic acid, itaconic acid, among many others. The electrically-conductive material employed in this preferred embodiment is an electrically-conductive carbon black having a particle size between about 20 and 40 $\mu$. The acrylonitrile polymer is dissolved in an inorganic solvent as specified in U.S. Pats. Nos. 2,558,730 and 2,916,348 or in an organic solvent as shown in Knudsen, *Textile Research Journal* 33, 13–20 (1963). The first and second streams are introduced into the inlet end of an interfacial surface generator as specified in U.S. Pat. No. 3,583,678 to produce a composite stream of between 8 and about 2 thousand total layers, which composite stream is then spun through a jet into a coagulating bath, wherein the polymer is precipitated, and the unitary filament so produced is washed countercurrently with water, stretched, crimped and dried.

The present invention may be better understood by a reference to the following illustrative examples, wherein all parts and percentages are by weight unless otherwise indicated.

EXAMPLE 1

This example specifies detail concerning a preferred method of making an integral, electrically-conductive filament according to the present invention, and sets forth some of the basic properties of the filament.

An acrylonitrile homopolymer, the preparation of which is exemplified by U.S. Pat. No. 2,847,405, was dissolved in a 60 percent solution of zinc chloride to produce a stock solution containing about 11 percent of the acrylic polymer. A first stream of this solution was provided in a conduit. To a portion of the stock solution which was used to provide the first stream was added a commercially-available electrically-conductive carbon black having an average particle diameter of 30 m$\mu$, in an amount sufficient to provide a dispersion having the following composition: 6% acrylonitrile homopolymer, 6% carbon black. A second stream was provided from this dispersion. Through the utilization of 2 metering pumps, the first and second streams were introduced simultaneously into the inlet end of an interfacial surface generator in the following proportion: 90 percent first stream and 10 percent second stream. The interfacial surface generator, which is pictured and specified in U.S. Pat. No. 3,583,678, comprised 1 individual interfacial surface generating element having 4 passageways therethrough. Accordingly, the total number of layers generated was 8 (4 conducting and 4 non-conducting). The resulting composite stream was spun through a jet into a coagulating bath of 42 percent zinc chloride in water, and the unitary filamentary structure so produced was washed countercurrently with water, elongated to approximately 9 times its original length, and dried in air. The filament was finally wound on a spool for subsequent utilization in the production of an antistatic fabric. The filament had a denier of 15 and a total carbon black concentration of 5%. Using a Keithley 610C Electrometer, the electrical resistance of the filament was determined to be $10^7$ ohms/cm. This filament, which is hereinafter designated Filament A, is compared with an acrylonitrile homopolymer filament of 15 denier, which is designated Filament B, which has an electrical resistance of $10^{14}$ ohms/cm. See Table I. Such a comparison reveals that the desirable textile properties of acrylic homopolymer filaments are retained by Filament A while significant conductivity is achieved.

EXAMPLE 2

A number of procedures otherwise identical to that of Example 1 were carried out, except that the number of electrically-conductive strata and the composition of each electrically-conductive stratum in the integral filament were varied as set forth in Table I . Filaments C-E and others described below were prepared and their physical properties were determined. The results of these determinations are also found in Table I.

TABLE I

| Filament | No of Electrically - Conductive Layers | [C] in Each Electrically - Conductive Layer | Total [C] in the Integral Filament | Resistance ohm/cm | Extension % | Tenacity, g/den. |
|---|---|---|---|---|---|---|
| A (This Invention) | 4 | 50% | 5% | $10^7$ | 13.8 | 3.9 |
| B (For Comparison) | 0 | 0 | 0 | $10^{14}$ | 10.0 | 4.0 |
| C (This Invention) | 64 | 60% | 10% | $10^5$ | 14.6 | 3.3 |
| D (This Invention) | 1000 | 50% | 2% | $10^9$ | 15.1 | 4.2 |
| E (This Invention) | 1000 | 50% | 5% | $10^9$ | 14.1 | 3.2 |

For more than about 1000 electrically-conductive layers, the resistance of the filament exceeded $10^9$ ohms/cm. For but one conductive layer, the filament fibrillated undesirably.

EXAMPLE 3

This example is illustrative of the utility and durability of an integral, electrically-conductive filament according to the present invention.

EXPERIMENT A

Filament A from Example 1 above was cut into staple lengths of 3 inches and blended by standard techniques with a 16-denier nylon 6 staple product having a staple length of 6 inches to produce a blend containing 2 percent of Filament A. This blend was processed by standard techniques into a 2.25/2 cotton count yarn having 3.5 Z turns and 2.5 S turns per inch. This yarn is designated Yarn A. Employing a jute backing material and utilizing a standard tufting machine, a 30 oz/yd$^2$ level loop carpet (hereinafter designated Carpet A) was prepared from Yarn A.

EXPERIMENT B

Carpet A was then subjected to the Static Electricity Test set fourth below. The results of such testing are reported in Table II below as "Initial Static Electricity."

Following the initial static electricity testing, Carpet A was then subjected to an accelerated wearing procedure for 60 hours, after which, testing of static electricity was again effected. The results of such testing are reported in Table II below as "Final Static Electricity."

From Table II it can be seen that carpet A was not only initially static protected (viz., it did not allow the generation of a static charge in excess of 3000 volts, which is generally accepted as the average threshhold level of human sensitivity), but carpet A was also static protected after extensive wear. Moreover, microscopic examination of the electrically-conductive filament A revealed substantially no deterioration thereof.

STATIC ELECTRICITY TEST

The fabric to be tested is first cut into sample squares 36 inches on a side. These samples are conditioned for 7 days by being hung from racks in a test room equipped with a rubber floor mat and having an area of at least 100 square feet, wherein the temperature is controlled at 70°± 2° F and the relative humidity is controlled at 20%±1%. Free circulation of air over all sample surfaces is effected, but the samples are not allowed to contact each other. A pair of Neolite or PVC-sole test shoes is also conditioned for the same period, under the same conditions.

Residual static charge on the rubber floor mat is then neutralized by passing twice over its entire surface a polonium wand, which consists of 6 polonium 210 alloy strips mounted end-to-end on a head attached to a handle. A fabric sample is then placed upon the rubber floor mat, and its residual static charge is neutralized in the same manner. The soles of the test shoes are then cleaned by sanding their entire surface with fine sandpaper, followed by a wiping with cheesecloth to remove dust particles.

Wearing the test shoes and holding a hand probe which is connected to an electrostatic detection head, a human operator steps upon the carpet sample and grounds the probe. Then while holding the hand probe, the operator walks normally on the sample at a rate of 2 steps a second for a 30-second period, being careful not to scuff or rub the shoes over the fabric. If at the end of the 30-second period the voltage has not reached a steady maximum, the walk is continued for an additional 30 seconds. The maximum voltage recorded during the walk is the static level of the sample, the average for two operators being recorded in Table II as static electricity in volts.

Table II

| Carpet Sample | Initial Static Electricity, Volts | | Final Static Electricity, Volts | |
|---|---|---|---|---|
| | Neolite Soles | PVC Soles | Neolite Soles | PVC Soles |
| A (This Invention) | 1400 | 1200 | 1500 | 1600 |

Pile fabrics such as carpet A, the prepatation of which is described above, when employed in an atmosphere having a relative humidity of at least 20% will not generate a static charge above about 3000 volts, which is in proximity to the threshold level of human sensitivity. Under the same conditions, a standard nylon 6 carpet can generate up to about 14,000 volts. Pile fabrics such as carpet A, moreover, when containing an integral, electrically-conductive filament having an electrical resistance between about $10^4$ and $10^9$ ohms/cm, do not present an electrocution hazard to those contacting them in the event of an accidental and simultaneous contact of such fabrics with a source of essentially unlimited electrical current, as is available from an ordinary electrical outlet, or an electrical appliance short-circuited by insulation failure.

The unique combination of properties possessed by the integral, electrically-conductive filament according to the present invention renders it especially suitable as a continuous filament or a staple product for use not only in carpets, rugs, and other floor coverings, but also in bed coverings, especially in hospitals; in curtains, especially in hospitals for separation of cubicles; in articles of apparel, especially uniforms and undergarments such as slips; in hosiery, especially in panty hose and half hose; in heater fabrics; and as sewing threads.

Although the present invention has been described in detail with respect to certain preferred embodiments thereof, it is apparent to those of skill in the art that variations and modifications in this detail may be effected without any departure from the spirit and scope of the present invention, as defined in the hereto-appended claims.

What is claimed:

1. An integral, electrically-conductive textile filament having a resistance of not more than about $10^9$ ohms/cm, the filament comprising:

a. from 2 to about 1000 electrically-conducting, longitudinally-directed strata of fiber-forming polymeric material having finely-divided particles of electrically-conductive carbon black uniformly dispersed therein, the concentration of electrically-conductive carbon black in each electrically-conducting stratum being within the following limits:

1. For 2 electrically-conducting strata: from about 30 percent by weight — at a total concentration of carbon in the integral filament of about ½ percent by weight — to about 70 percent by weight — at a total concentration of carbon in the integral filament of about ¼ percent by weight; and
2. For about 1000 electrically-conducting strata: from about 30 percent by weight — at a total concentration of carbon in the integral filament of about 12 percent by weight — to about 70 percent by weight — at a total concentration of carbon in the integral filament of about 2 percent by weight; and b. in coextensive union with each electrically-conducting stratum along the length of at least one major surface thereof, a non-conducting stratum of the same fiber-forming polymeric material.

2. The integral, electrically-conductive textile filament of claim 1, wherein the polymeric material is an acrylonitrile polymer having at least about 85 percent by weight of acrylonitrile and up to about 15 percent by weight of another polymerizable mono-olefinic monomer copolymerizable therewith.

3. The integral, electrically-conductive textile filament of claim 2, wherein there are 4 electrically-conducting, longitudinally-directed strata of fiber-forming polymeric material, each having finely-divided particles of electrically-conductive carbon black uniformly dispersed therein in a concentration of 40 – 60 percent by weight, the total concentration of carbon in the integral filament being between 4 and 6 percent by weight.

4. A conductive spun yarn comprising the integral, electrically-conductive textile filament of claim 1 blended with a non-conducting staple product.

* * * * *